US005106085A

United States Patent [19]

Lewy

[11] Patent Number: 5,106,085

[45] Date of Patent: Apr. 21, 1992

[54] BASEBALL HITTING PRACTICE APPARATUS

[76] Inventor: Winston B. Lewy, 6371 Adelaide Pl., Los Angeles, Calif. 90042

[21] Appl. No.: 666,149

[22] Filed: Mar. 7, 1991

[51] Int. Cl.[5] ..... A63B 69/40

[52] U.S. Cl. ..... 273/26R; 273/26 E

[58] Field of Search ..... 273/26 E, 29 A, 26 EA, 273/196, 200 R, 58 C

[56] References Cited

U.S. PATENT DOCUMENTS

| | | | |
|---|---|---|---|
| 2,772,882 | 12/1956 | Anson | 273/26 G |
| 3,301,556 | 1/1967 | Hamilton, Jr. et al. | 273/26 G |
| 3,342,487 | 9/1967 | David | 273/26 R |
| 3,366,383 | 1/1968 | Lentine | 273/26 G |
| 3,815,906 | 6/1974 | Hermo | 273/26 R |
| 4,258,916 | 3/1981 | Barnes | 273/26 R |
| 4,632,349 | 12/1986 | Ryan | 273/58 C |
| 4,664,375 | 5/1987 | Tetreault | 273/26 R |
| 4,674,744 | 6/1987 | Walsh | 273/26 G |
| 4,789,053 | 11/1988 | Barnes, Jr. | 273/26 R |
| 4,828,262 | 5/1989 | Heney | 273/26 G |

*Primary Examiner*—Theatrice Brown
*Attorney, Agent, or Firm*—John W. Huckert

[57] ABSTRACT

A multi-purpose baseball practice apparatus for greatly improving a user's batting form and hitting average comprises a simulated home plate area together with guide markers to assist a user in achieving the correct batting stance as well as stride while practicing with the device, lower ball support structure to permit balls at any possible area to be hit at, overhead ball suspension structure to provide additional practice for improving a user's bat speed, the overall apparatus being formed of lightweight plastic pipe for easily and quickly being set up and adjusted for all types of batters, whether left or right handed, big or small, fat or thin, etc.

12 Claims, 10 Drawing Sheets

BASEBALL HITTING PRACTICE APPARATUS

BACKGROUND OF THE INVENTION

1. Field of the Invention

This invention relates generally to devices for practicing and improving the hitting of a baseball.

2. Description of the Prior Art

A common problem with known devices for baseball practice is that they do not improve ones batting and hitting skills very much, or well. And known apparatus for improving a user's stance generally is not suitable for improving his or her batting hitting average, and furthermore such apparatus when available is very complicated and expensive.

Another common problem of known type baseball practice apparatus is that they are not inexpensive, nor are they easily set up and adjusted by an unskilled user.

A further problem is that known type baseball practice apparatus can not be adjusted for all types of pitches of a baseball, i.e. low, high, wide, close, etc. in addition to right in the center.

A still further problem is that known type baseball practice apparatus can not be easily and quickly adjusted for all types of hitters, and for either right handed or left handed batters, which of course is very desirable in such batting practice structure.

Existing prior patents which may relate to this invention are as follows: U.S. Pat. Nos. 4,473,227, Klaus, Sep. 25, 1984; 3,979,116, Matchick, Sep. 7, 1976; 3,342,487, David, Sep. 19, 1967.

The Klaus patent shows a baseball pitcher's practice device having a verticle support frame for the purpose of improving a pitcher's throwing skills. Matchick teaches a training device for a batter which can improve the batter's stride performance. And the patent to David is a batter's stance and stride practice plate.

However, none of these patents show the device of the present invention, nor do any of the known prior art devices offer the new and novel features of the present invention.

SUMMARY OF THE INVENTION

An object of the present invention is to provide apparatus for the practice hitting of a baseball for the purpose of improving a player's batting skills and hitting average.

Another object of this invention is to provide a device for baseball hitting practice which is completely functional and yet easily assembled and adjusted for use by any type of player, novice or expert.

A further object of this invention is to provide a convenient structure for practicing both form and method of properly hitting a baseball, as well as practice structure for greatly improving a user's skills at same.

A still further object is a device having a main platform for holding and supporting baseballs to be hit at various pre-determined positions which includes a simulated home plate with player position guide indicators, and overhead structure for adjustably hanging other baseballs for determining a user's bat hitting speed.

Yet another object is apparatus with an upper platform for suspending in an adjustable manner a plurality of baseballs in various configurations for indicating to a user bat speed. The adjustment structure being simple and easy to use.

A still further object is a baseball practice device having a plurality of overhead baseball suspension strings, a ball adjustment pole with string clamps for holding the baseballs at desired pre-determined positions; a main support with simulated home plate, stance and stride indicators therewith; and further baseball support pipes for simulating balls thrown at any number of desired positions relative to the user at bat.

The present invention offers many very important and desirable advantages and benefits over known baseball practice devices and apparati. Namely, a multi-purpose baseball practice device for permitting a user thereof to practice and improve his or her stance, stride, and hitting form, and to substantially increase the number of hits made. This being so regardless of the size or shape of the user, whether left or right handed, or the simulated position of the ball being hit.

The device comprises a simulated home plate for basic positioning of a user. Plastic pipe is the prefered material for making and forming the framework. However, galvanized pipe may be used. Affixed to the home plate structure are guide indicators for the purpose of showing a user the correct position of the feet, i.e., the stance, and then how far to stride when swinging the bat at one of the practice baseballs.

The practice baseballs are structurally supported and arranged so that any position of thrown ball can be accurately simulated. That is, simulation of a baseball thrown dead center, wide or close, high or low. Every conceivable ball position can be simulated with the present invention.

Another important feature of this invention is the structure provided for improving the bat speed of a user. This is extremely important because the speed of a users bat relative to the speed of the thrown baseball has a lot to do with making a satisfactory and successful hit.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENT

Figure 1:
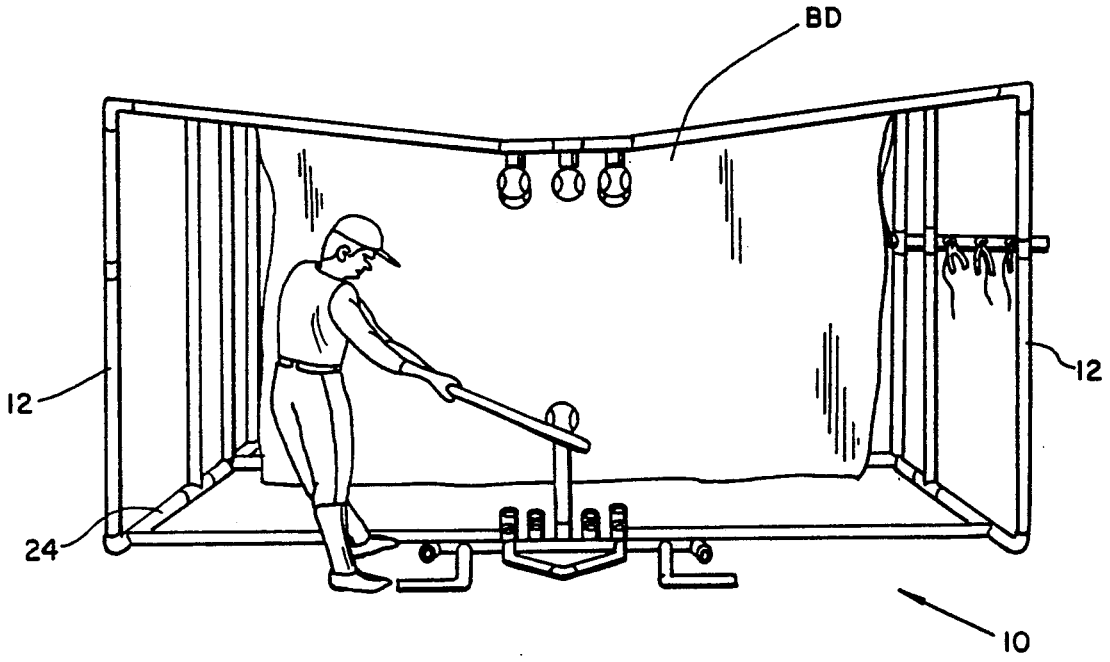
FIG. 1 is a perspective view from the front of the multi-purpose baseball practice hitting apparatus of the present invention with the upper overhead baseballs in withdrawn position.
Figure 2:
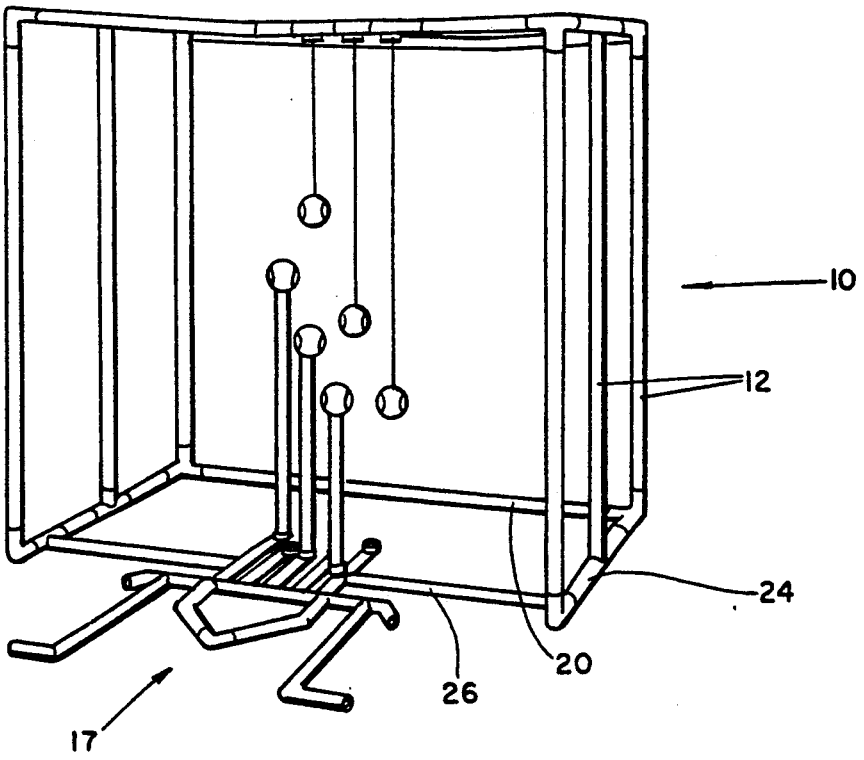
FIG. 2 is a perspective view from the right front of the multi-purpose baseball practice hitting apparatus of the present invention with the overhead baseballs in practice position.
Figure 3:
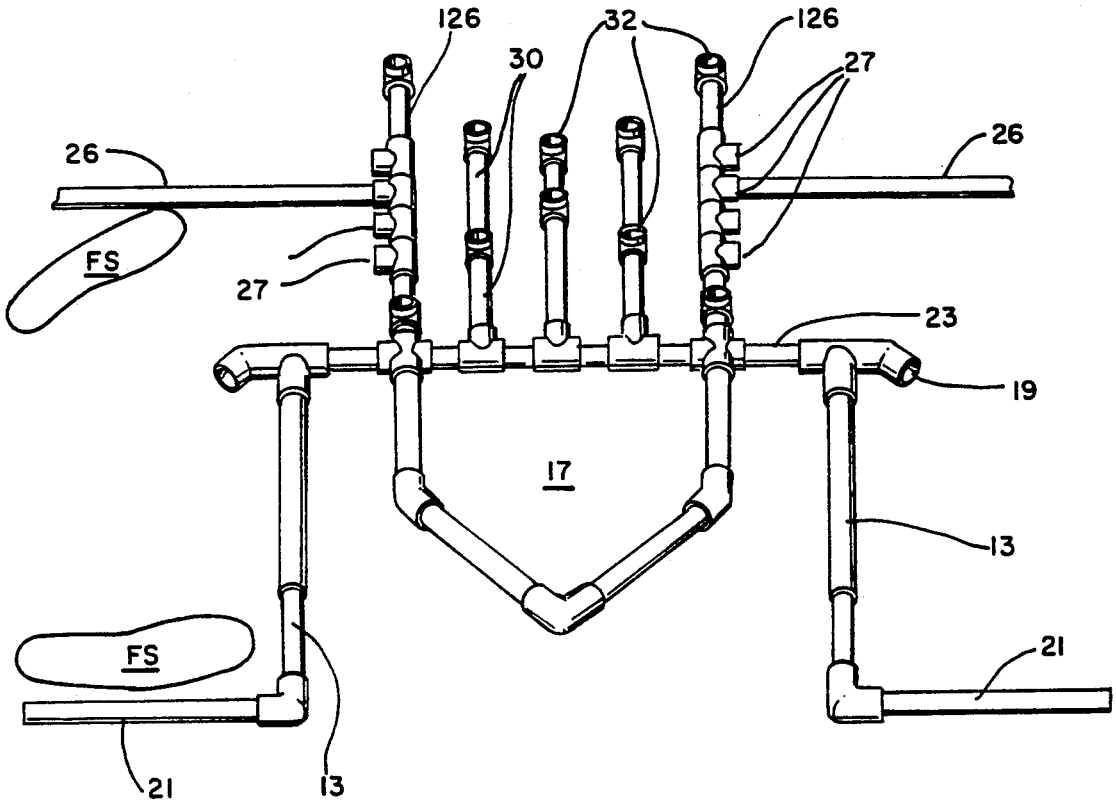
FIG. 3 is a perspective view of the simulated home plate with bottom support holder positions for the lower baseballs.
Figure 4:
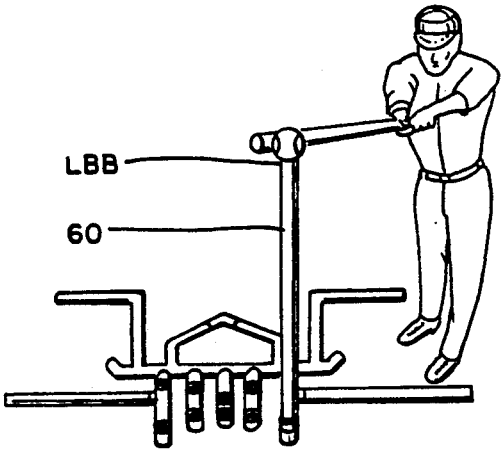
FIG. 4 is a pitcher's perspective view of the home plate of FIG. 3 having a lower baseball with its support mounted in one of the support holders.
Figure 5:
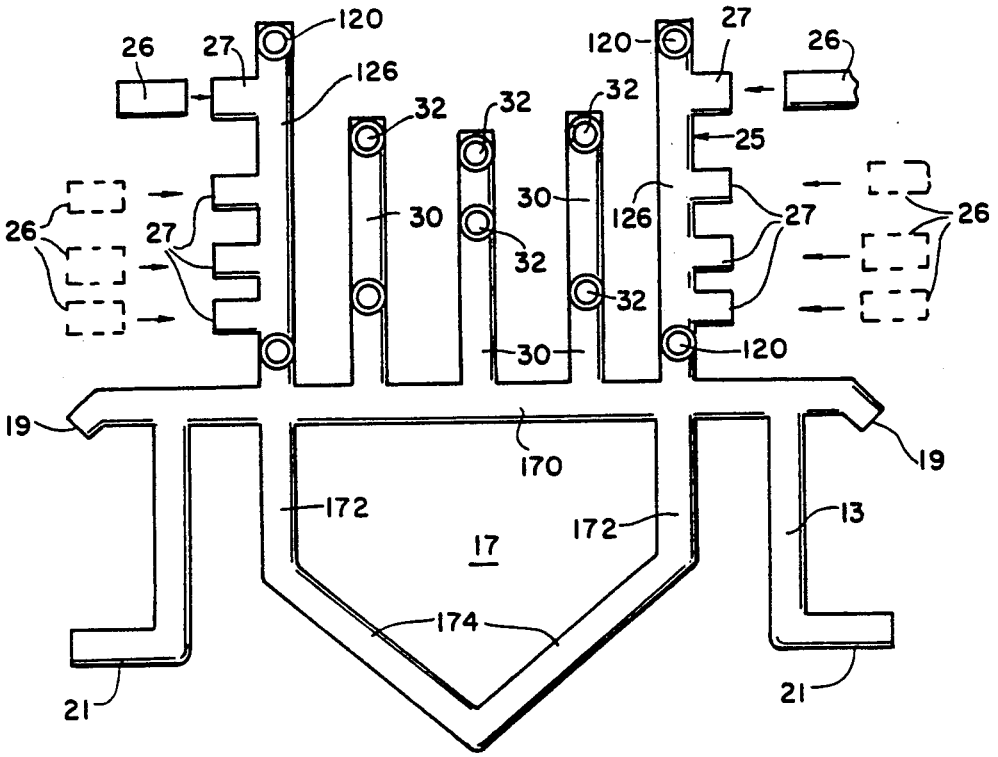
FIG. 5 is a top plan view of the home plate structure of FIG. 3.
Figure 6:
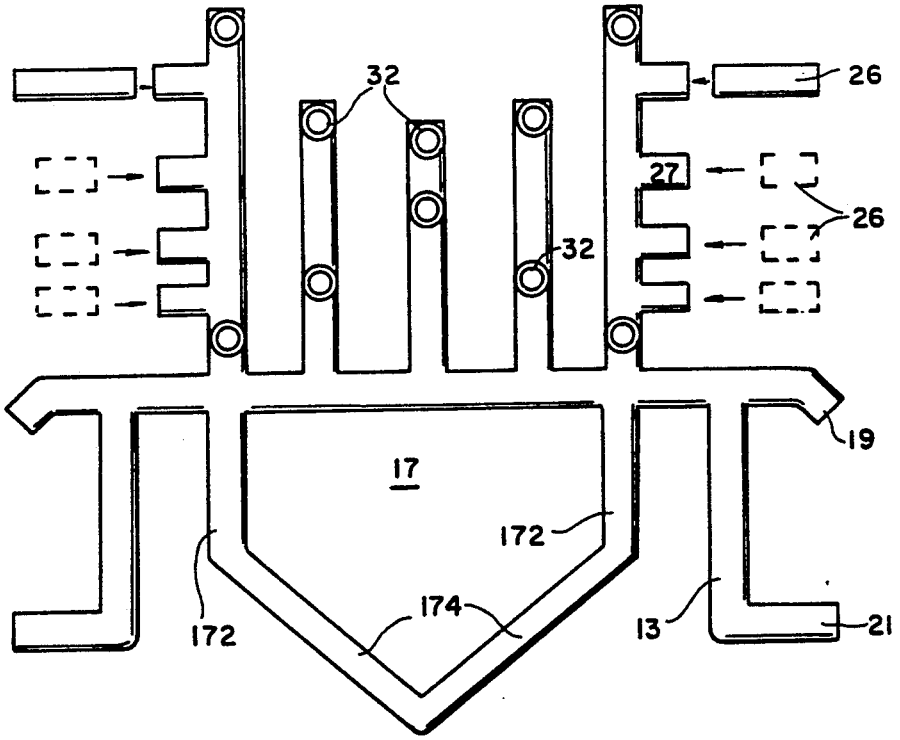
FIG. 6 is a detailed top plan view of the home plate structure of FIGS. 3 and 5 with recommended dimensions.

Looking at FIGS. 1 and 2 of the drawings reference numeral 10 refers to the preferred embodiment of the baseball practice hitting apparatus of the present invention. An overall rectangular framework of plastic pipe and fittings comprise the main part of the device. Vertical pipes 12 are held and supported by bottom side pipes 24. A bottom back pipe 20 holds the rear of the framework together while short front pipes 26 adjustably mate with the home plate structure 17. A plurality of horizontal receptacles 27 are mounted outwardly on extension pipes 126. An indication of the desired batter's stride is determined by which of the receptacles 27 the associated ends of pipes 26 are inserted. Pipes 13 and 21 are provided as an indication of a user's desired stance.

Short pipes 30 have vertical receptacles 32 attached thereto for holding a replacable vertical support rod 60 which in turn supports a lower practice baseball LBB. The different positions of the plurality of vertical receptacles 32 together with support rods 60 of different heights permit a user to practice hitting with the practice ball at all the possible positions which can be encountered during an actual game.

The simulated home plate structure 17 consists of pipe sections 170, 172 and 174 appropiately secured together with connecting fittings. Such may be of the compression type, screw type, or for a permanent arrangement plastic pipe solvent may be used.

Once the lower framework with home plate structure has been assembled the owner/user may begin to practice his or her batting stance and stride, and also hit the practice ball at many different positions. Such as waist high inside, low ball outside, a strike ball, etc.

Looking at FIGS. 7–9 the bat speed improving apparatus will now be described. This is shown at the top of the framework in FIGS. 1 and 2 and provides a user with a way to make an improvement in bat speed.

Figure 8:
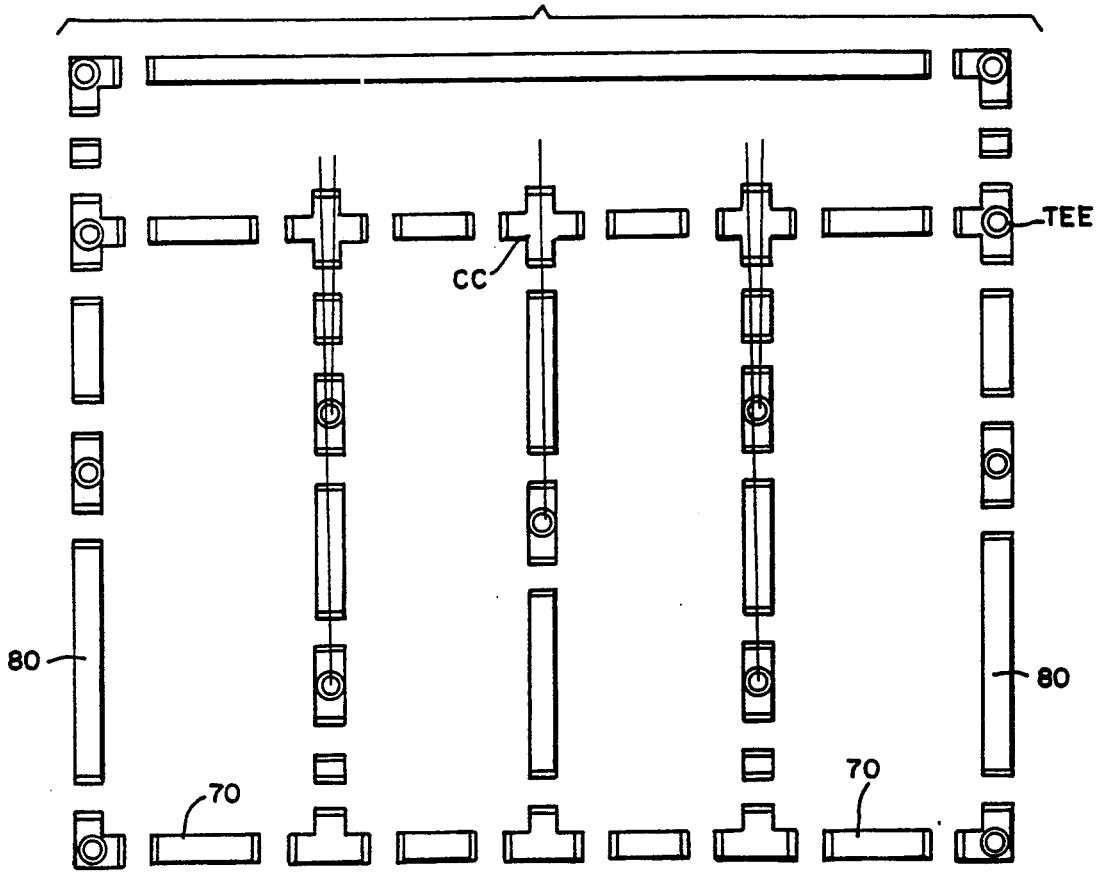
FIG. 8 is a detailed top plan view of the piping and fittings of the top section of FIG. 7.

As depicted in FIG. 8 a number of short pipes, tees, cross connectors and elbows are used to make the top section of the framework. The recommended lengths of the plastic pipes, etc. are as indicated. While slight variations will work, it has been found that those listed are the best.

Figure 7:
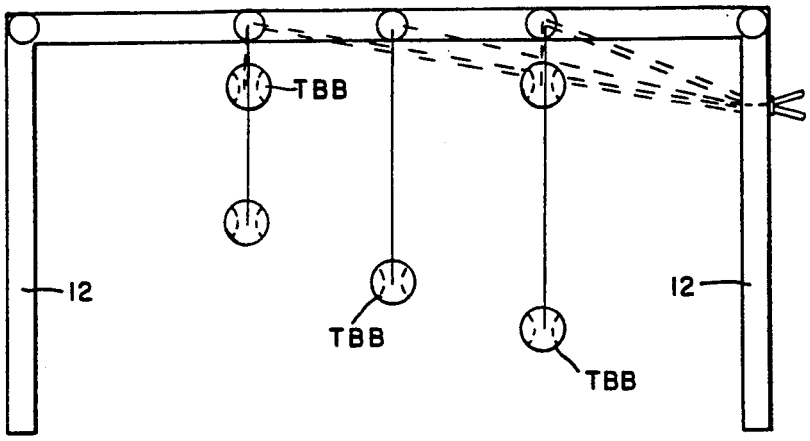
FIG. 7 is a front elevational view of the top section of the apparatus as shown in FIG. 2 with the bat speed improving baseballs in practice position.
Figure 9:
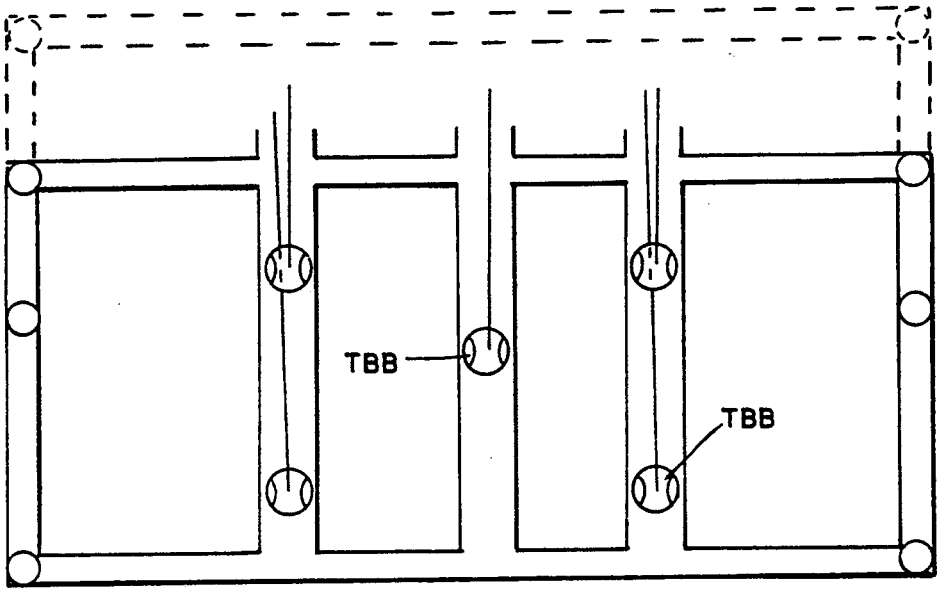
FIG. 9 is a top plan schematic view of the top section of FIGS. 7 and 8 showing the 2-1-2 configuration of the top bat speed improving baseballs.
Figure 10:
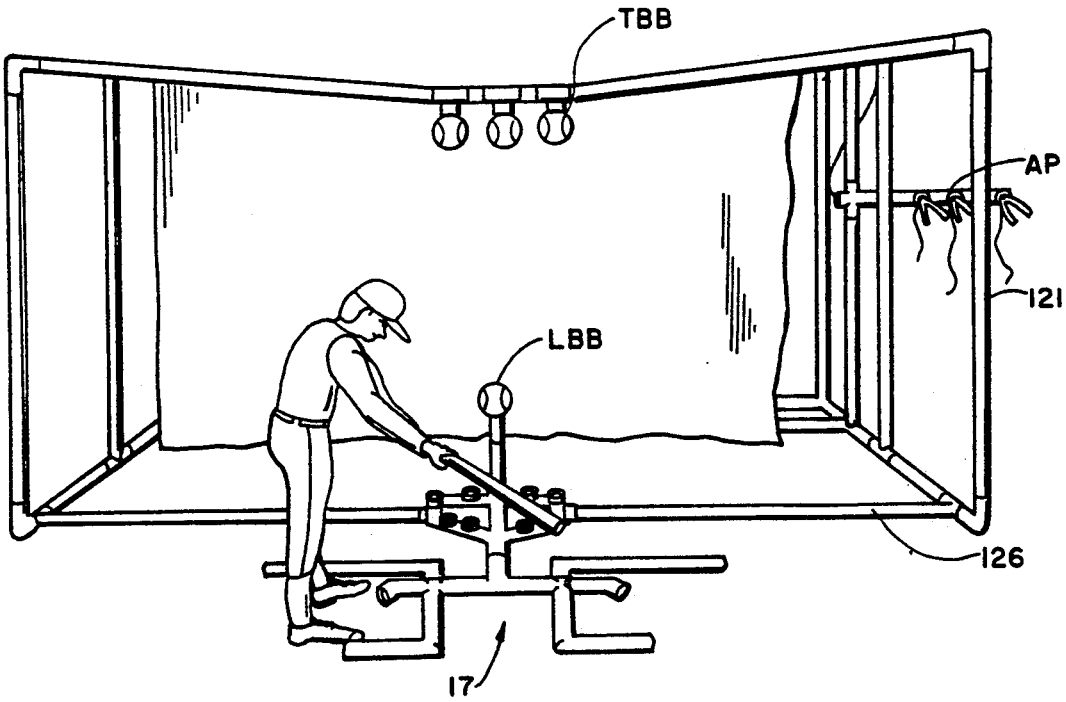
FIG. 10 is a front perspective view of a second embodiment of the multi-purpose baseball practice hitting apparatus having differently configured bottom and top sections.
Figure 11:
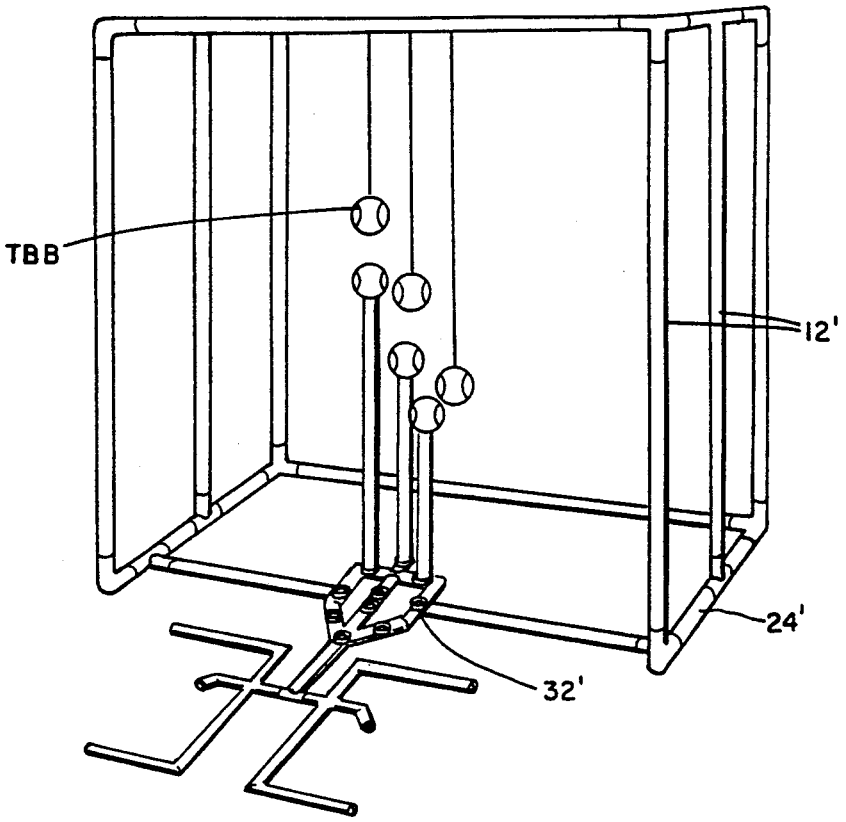
FIG. 11 is a perspective view from the right front of the second embodiment of FIG. 10.

FIGS. 7 and 9 show the 2-1-2 configuration of the upper practice balls of the primary embodiment. These upper balls are suspended from strings which pass upwardly through pipe tees and then are fed to an adjustment. pole on the side of the overall framework as best seen in FIG. 2. Vise clamps VC on the free ends of the strings are used to adjust the desired vertical positions of the upper or top baseballs TBB.

The upper balls are used to improve a user's bat speed. A good batter should have a controlled bat swing as a result of strong wrist and forearm muscles. To use the bat speed apparatus of this invention, first adjust the appropiate top baseball to the user's strike zone; whether high, low, middle, inside or outside. Second, the batter should assume a position having full plate coverage. Third, start the swinging of the hanging ball in a straight forward motion. Now the hit area of the bat (two inches from the top and seven inches down) must come in contact with the moving ball. Fourth, use wrist only, no shoulders or striding. Hit the ball straight ahead kind of a punch, then get the wrist and bat back before the ball returns. Repeat as above. Do this every day for 15 minutes. After a few weeks of such practice a user's bat speed will have been greatly improved.

FIGS. 10–15 show the features of a second embodiment of the invention. Similar parts of this embodiment to those of the first embodiment use the same reference numerals with a prime mark thereafter. The differences mainly being in the placement of the simulated homeplate 17′ and the verticle receptacles 32′ for the lower baseball support rods 60′. And the upper ball configuration which is 1-3-1.

Figure 17:
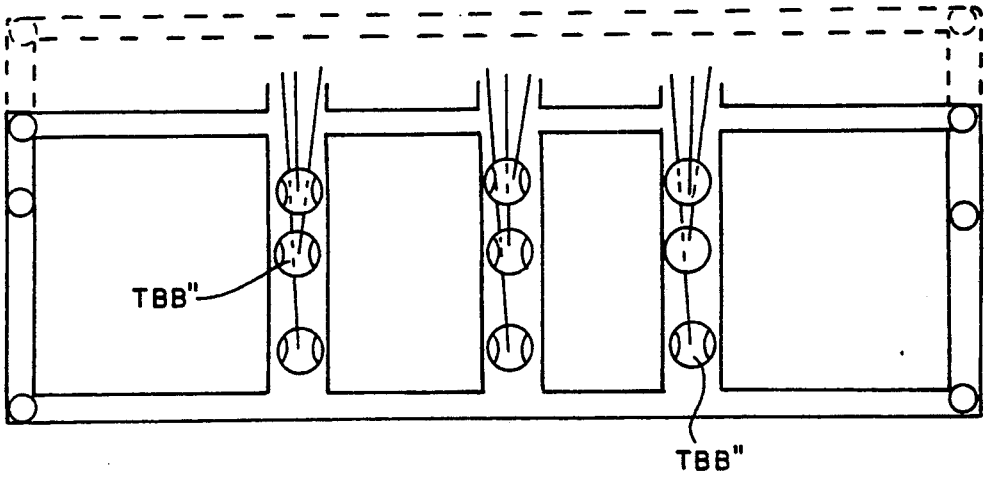
FIG. 17 is a plan schematic view of the top section of the third embodiment showing the 3-3-3 ball configuration.
Figure 12:
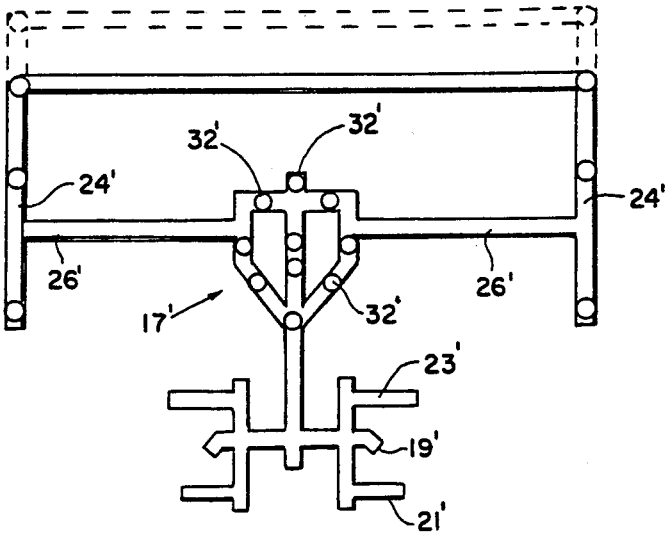
FIG. 12 is a plan view of the bottom section of the apparatus of the second embodiment of FIGS. 10 and 11.
Figure 13:
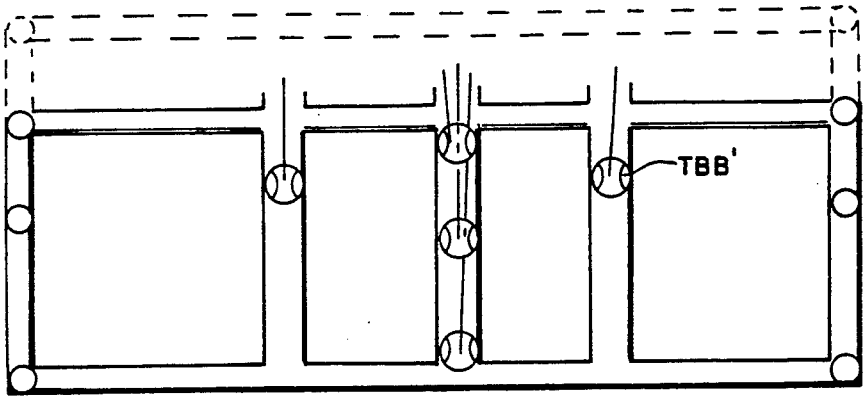
FIG. 13 is a top plan schematic view of the top section of FIGS. 10 and 11 showing the 1-3-1 configuration of the top bat speed improving baseballs.
Figure 14:
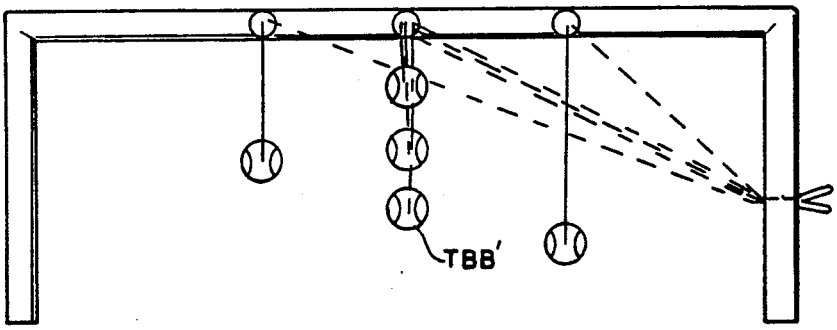
FIG. 14 is a front schematic view of the top section of FIG. 13.
Figure 15:
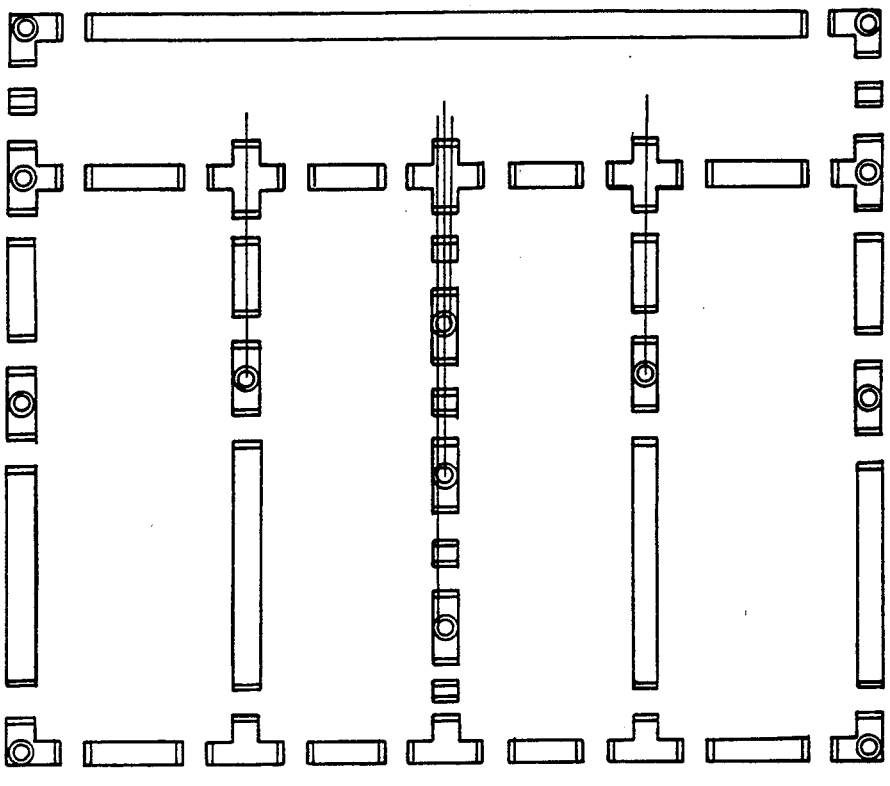
FIG. 15 is a detailed plan view of the top section of the second embodiment.
Figure 16:
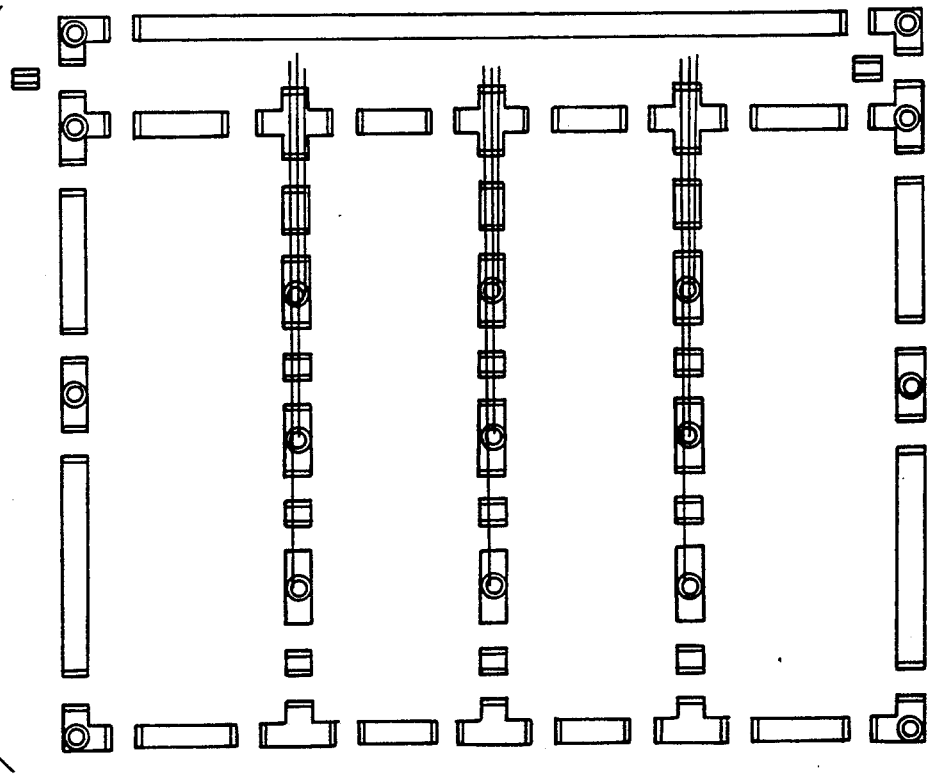
FIG. 16 is a detailed plan view of the top section of a third embodiment.
Figure 18:
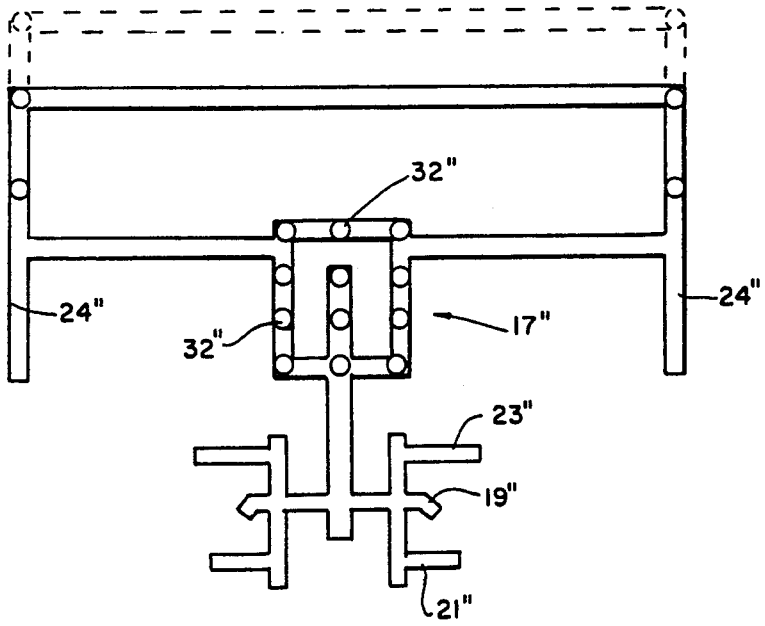
FIG. 18 is a top plan view of the bottom section of the third embodiment.

FIGS. 16–18 show the features of a third embodiment of the invention. Similar parts of this embodiment to those of the first embodiment use the same reference numerals with a double prime mark thereafter. The differences again mainly being in the placement of the simulated homeplate 17″ and the verticle receptacles 32″ for the lower baseball support rods 60″. And the upper ball configuration which is 3-3-3.

Figure 19:
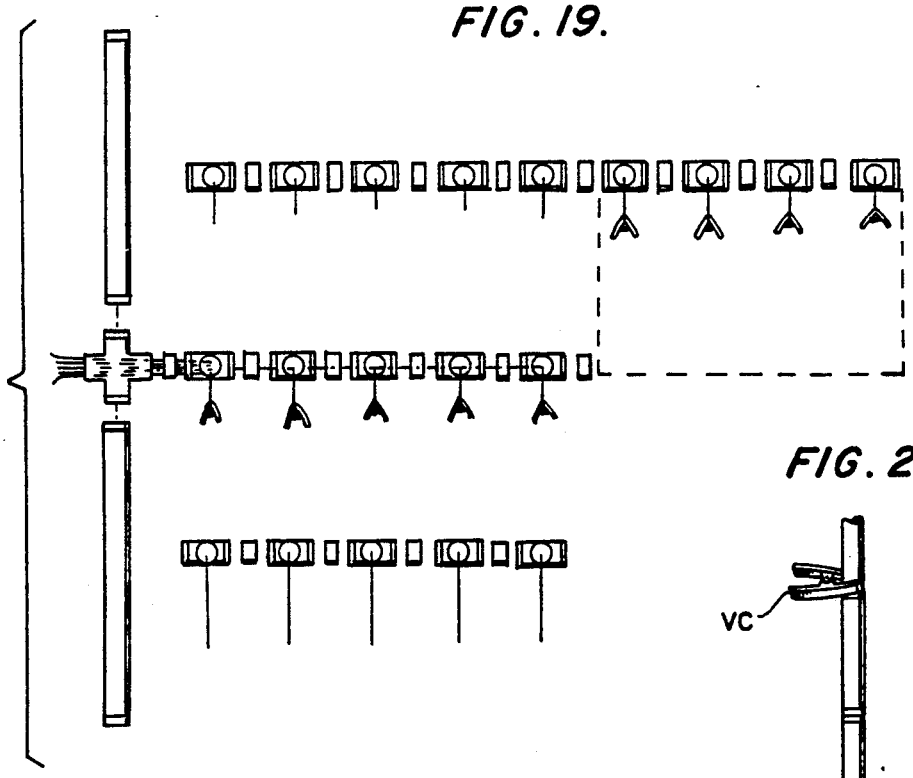
FIG. 19 is a composite view of the top section of all three embodiments showing the suspension and adjustment strings therefor.
Figure 20:
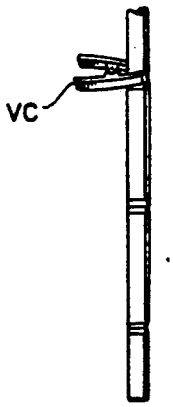
FIG. 20 is an elevational view of the bat speed improving ball adjustment pole for all three embodiments.

FIG. 19 depicts the bat speed improving ball adjustment pole 133. The vise clamps VC for the plurality of overhead strings are shown. FIG. 20 shows how reference strips help a user make the correct adjustment.

Figure 21:
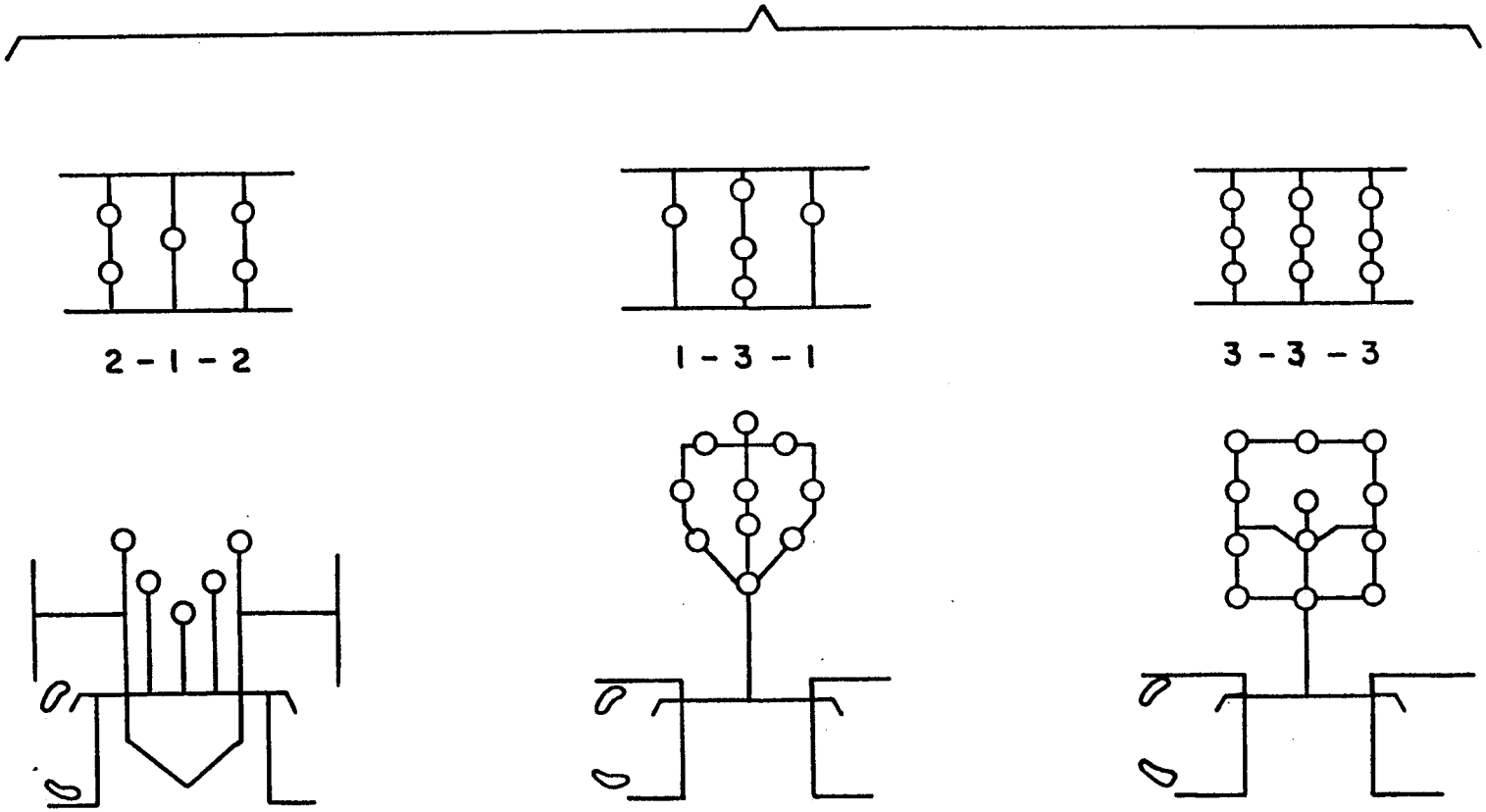
FIG. 21 is a comparison chart in schematic form depicting the structures which are different between the three embodiments.

FIG. 21 is a showing of the differences between all three embodiments.

The foregoing is considered as illustrative only of the principles of the invention. Further, since numerous modifications and changes will readily occur to those skilled in the art, it is not desired to limit the invention to the exact construction shown and described, and accordingly, all suitable modifications and equivalents may be resorted to, falling within the scope of the invention.

What is claimed is:

1. A baseball practice hitting apparatus comprising:

a framework formed of lightweight plastic pipe and fittings;

home plate means attached to said framework for simulating the home plate of an actual baseball playing field diamond;

guide means attached to said framework adjacent said home plate means to provide a user of the apparatus with an indication of proper stance and stride relative to said home plate during practice;

replaceable support means attached to said home plate and extending upwardly therefrom for holding a baseball at a pre-determined desired position above said home plate during practice; and suspension means attached to overhead framework structure and extending downwardly for holding another baseball above said home plate for improving the bat speed of a user of the apparatus.

2. A baseball practice hitting apparatus as set forth in claim 1, wherein said support means for holding a baseball at a pre-determined desired position above said home plate includes at least one vertical upright and a structure having a plurality of spaced holders for receiving said at least one verticle upright which in turn supports said baseball thereupon.

3. A baseball practice hitting apparatus as set forth in claim 2, wherein said suspension means includes a plurality of strings having one end thereof attached to said overhead framework structure, each string having a baseball attached to its other end, and adjustable means for each string for changing the position of the balls with respect to said home plate.

4. A baseball practice hitting apparatus as set forth in claim 3, wherein said guide means adjustably mounted includes adjustable mounting structure connected to said framework the home plate framework which is variable so that various sizes of users may be accomendated.

5. A baseball practice hitting apparatus as set forth in claim 1, wherein said home plate means comprises a plurality of pipes affixed together in the approximate shape of an actual baseball field home plate, and said guide means being additional pipes attached to those of the home plate.

6. A baseball practice hitting apparatus as set forth in claim 5, wherein said suspension means includes a plurality of strings having one end thereof attached to said overhead framework structure, and adjustable means for said strings for changing the position of said balls with respect to said home plate.

7. A baseball practice hitting apparatus as set forth in claim 6, wherein said adjustable means for changing the position of said balls with respect to said home plate includes a vise clamp attached to each string and framework structure.

8. A baseball practice hitting apparatus comprising:

home plate structure to simulate home plate of a baseball playing field;

means attached to said home plate structure for indicating to a batter the proper stance and stride for hitting a ball;

upwardly extending support means attached to said home plate structure for supporting a baseball at a desired position above said home plate; and suspension means attached to and extending downwardly from support structure and suspending a baseball above said home plate for improving the user's bat speed.

9. A baseball practice hitting apparatus as set forth in claim 8, wherein said suspension means includes a plurality of strings, and adjustable means on said strings for changing the position of said balls with respect to said home plate.

10. A baseball practice hitting apparatus as set forth in claim 9, wherein said home plate structure includes a structure having a plurality of spaced holders for receiving said support means.

11. A baseball practice hitting apparatus as set forth in claim 10, wherein a plurality of upwardly extending support means of various heights are provided.

12. A baseball practice hitting apparatus as set forth in claim 10, wherein said means attached to said home plate structure is adjustable.

* * * * *